US006926167B2

(12) United States Patent
Mazlout et al.

(10) Patent No.: US 6,926,167 B2
(45) Date of Patent: Aug. 9, 2005

(54) CARTON DISPENSING MACHINE

(76) Inventors: Lazhar Mazlout, 5115 Trans Island, Suite 220, Montreal, PQ (CA), H3W 2Z9; Benen Olidi, 5115 Trans Island, Suite 220, Montreal, PQ (CA), H3W 2Z9

( * ) Notice: Subject to any disclaimer, the term of this patent is extended or adjusted under 35 U.S.C. 154(b) by 175 days.

(21) Appl. No.: 10/601,749

(22) Filed: Jun. 23, 2003

(65) Prior Publication Data

US 2005/0000977 A1 Jan. 6, 2005

(51) Int. Cl.[7] ..... B65H 1/08
(52) U.S. Cl. ..... 221/232; 221/236
(58) Field of Search ..... 221/231, 232, 221/226, 224, 236, 238, 277

(56) References Cited

U.S. PATENT DOCUMENTS 4,702,392 A * 10/1987 Rachman ..... 221/151
5,383,569 A * 1/1995 Muto ..... 221/203

* cited by examiner

*Primary Examiner*—Kenneth Noland
(74) *Attorney, Agent, or Firm*—J. Wiley Horton

(57) ABSTRACT

A vending machine for large flat objects such as collapsed boxes or garment containers. A cabinet is provided containing a plurality of flat objects in an upright orientation. A control box attached to the cabinet receives bills or coins as payment for an object contained within the cabinet—such as a box. Once payment is received, feed mechanisms propel the plurality of flat objects toward the front of the machine. A cross feed mechanism then propels a single flat object out a dispensing slot, where it can be grasped and removed by a user.

9 Claims, 18 Drawing Sheets

CARTON DISPENSING MACHINE

CROSS-REFERENCES TO RELATED APPLICATIONS

Not applicable.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of vending machines. More specifically, the invention comprises a machine which stores and dispenses flat items such as cartons or boxes.

2. Description of the Related Art

Cartons or boxes are often needed for transportation and storage of small items. Such cartons or boxes (which terms are understood to be interchangeable throughout the remainder of this disclosure) are often designed to fold or collapse into a flat state for more convenient storage when they are not in use. Such boxes are often unavailable when they are needed most.

As one example, travelers often arrive at the airport with items they intend to carry on board an aircraft. Due to the increasing state of air travel security, these travelers may be informed that they must check these hand-carried items. The traveler may not have a piece of luggage available. A box would therefore be useful. The airlines, however, are increasingly reluctant to furnish passengers with storage boxes. The present invention seeks to provide boxes on demand by storing and dispensing them through a vending machine.

BRIEF SUMMARY OF THE PRESENT INVENTION

A vending machine for large flat objects such as collapsed boxes or garment containers. A cabinet is provided containing a plurality of flat objects in an upright orientation. A control box attached to the cabinet receives bills or coins as payment for an object contained within the cabinet—such as a box. Once payment is received, feed mechanisms propel the plurality of flat objects toward the front of the machine. A cross feed mechanism then propels a single flat object out a dispensing slot, where it can be grasped and removed by a user.

REFERENCE NUMERALS IN THE DRAWINGS

Figure 1:
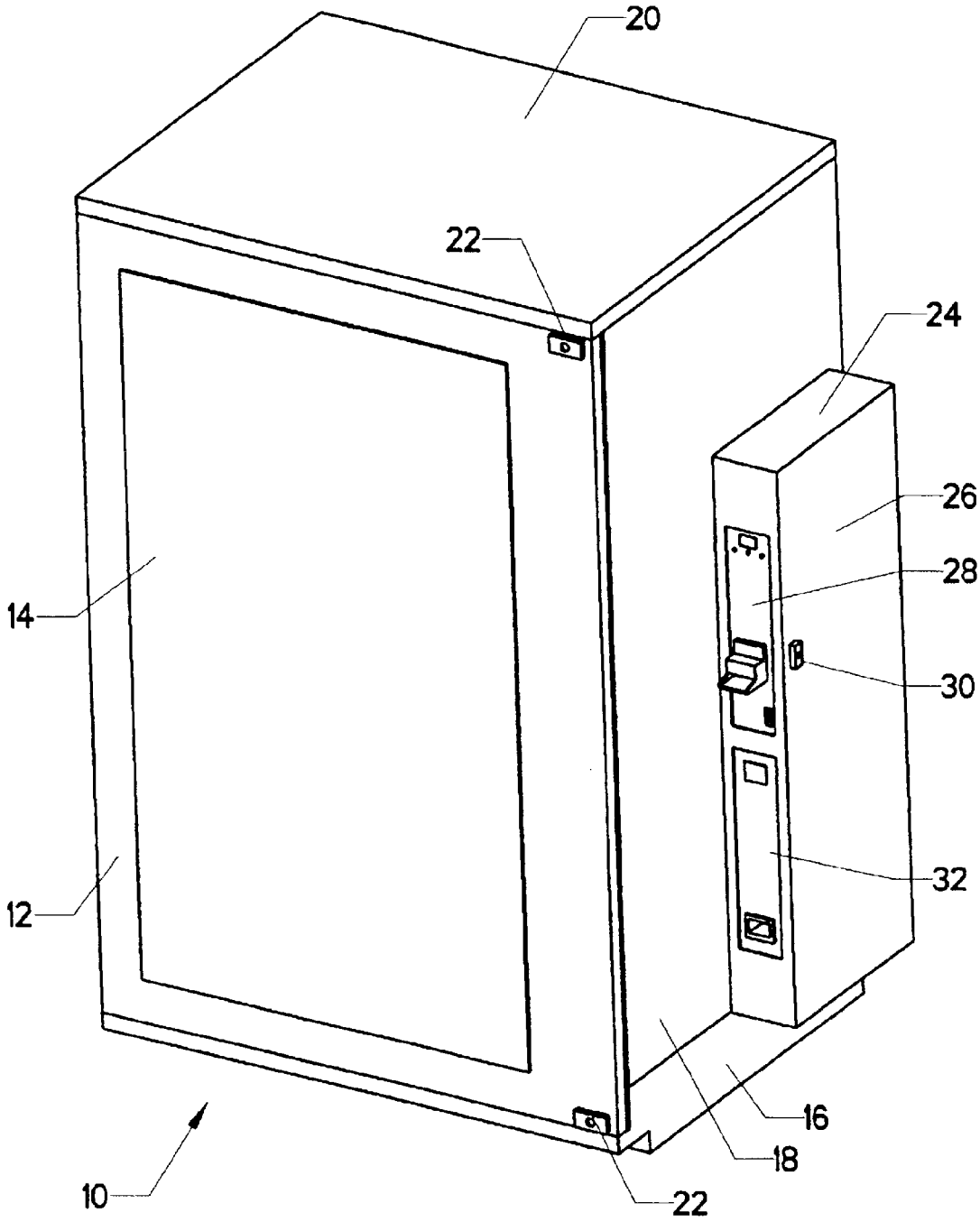
FIG. 1 is an isometric view, showing the proposed carton dispensing machine.

10 carton dispensing machine
12 main door
14 display panel
16 base
18 right side panel
20 top panel
22 lock
24 control box
26 control box door
28 status panel
30 lock
32 change panel
34 LED display
36 ready light
38 exact change light
40 empty light
42 bill receiver
44 coin slot
46 coin return
48 dispenser slot
50 carton
54 carton cavity
56 upper beam
58 lower beam
60 fixed column
62 adjuster column
64 left side panel
66 crossfeed assembly
68 left feed assembly
70 right feed assembly
72 left pressure plate
74 right pressure plate
76 support panel
78 left backing plate
80 left support beam
82 gear motor
84 left drive helix

86 drive screw
88 right support beam
90 right drive helix
92 right backing plate
94 ejector
96 transverse screw drive
98 crossfeed bracket
100 lead carton
102 next carton
104 entrance stop
106 holding flange
108 feed grove
110 tray
112 carton separator
114 carton stack
120 proximity sensor
122 remove carton light
124 vertical wall

DETAILED DESCRIPTION OF THE INVENTION

The present invention is a vending machine for dispensing flat objects—typically cartons. Throughout this disclosure, the term "carton" will be understood to mean any type of box, garment bag, or other container which can be collapsed into a flat state. These objects are typically made of corrugated cardboard, but can also be made of sheet molding compound, thin gauge metal, and many other materials. The invention is capable of accommodating virtually any type of flat object. However, for purposes of illustration, a stack of collapsed cardboard packing boxes will be used throughout this disclosure.

FIG. 1 shows carton dispensing machine 10 in its assembled state—ready for use. A rectangular cabinet is formed by various panels using common prior art techniques. Base 16, right side panel 18, and top panel 20 are shown. A rear panel and left side panel are also present. The front of the cabinet is sealed by main door 12, which is hinged on its left side. Main door 12 is customarily locked when closed, using the two locks 22. Display panel 14 is provided on the front of main door 12. It may simply be a glass frame for accommodating an advertising placard. On the other hand, it may be a sophisticated lighted display as commonly found on soft drink vending machines. The machine is typically located in public areas such as airports. Thus, display panel 14 is used to attract the attention of potential customers and inform them of the fact that the machine offers boxes for sale.

Control box 24 is attached to the side of the machine. Its front face contains status panel 28 and change panel 32. Control box door 26 swings open to provide access to the interior in order to perform maintenance functions and to retrieve money deposited in the machine. It is customarily locked by lock 30. Main door 12 provides access to the cabinet for loading new cartons into the machine. Control box door 26 provides access to the money received within control box 24. As the functions of loading the cartons and retrieving the money may be performed by different persons, it is advisable to key locks 22 and lock 30 differently.

Figure 2:
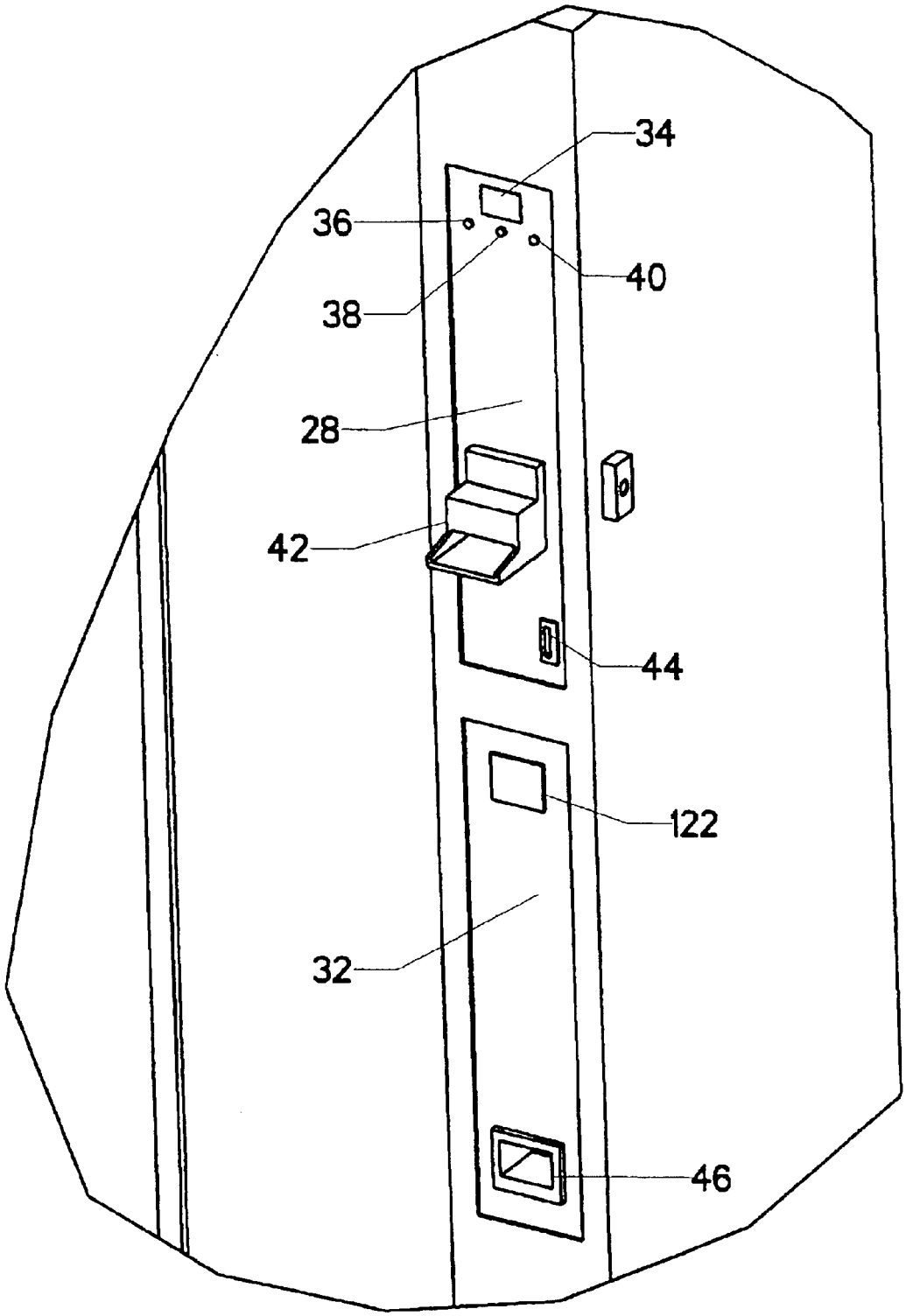
FIG. 2 is a detail view, showing the control box.

FIG. 2 is a detail view showing status panel 28 and change panel 32. Status panel 28 collects money from persons desiring to purchase a carton. Bill receiver 42—which is familiar to those skilled in the art—is provided to accept paper money. Coin slot 44 is provided to accept coins. A control unit is provided within the machine to count the money received and initiate the various functions the machine performs. LED display 34 informs the user how much money has been deposited. The price required to initiate the vending cycle is set in the control unit. Once this amount of money is received, the vending cycle is initiated. If change is owed, this is delivered though coin return 46.

Three indicator lights are provided on status panel 28. Ready light 36—which is customarily green—indicates that the machine is ready to receive money and vend a box. Exact change light 38—which is customarily yellow or orange—indicates that the machine is running low on change and that exact change should be provided. Empty light 40—which is customarily red—indicates that the machine is out of cartons. In this state, of course, ready light 36 will not be illuminated. Remove carton light 122 is also provided. Its function will be explained in the following.

Figure 3:
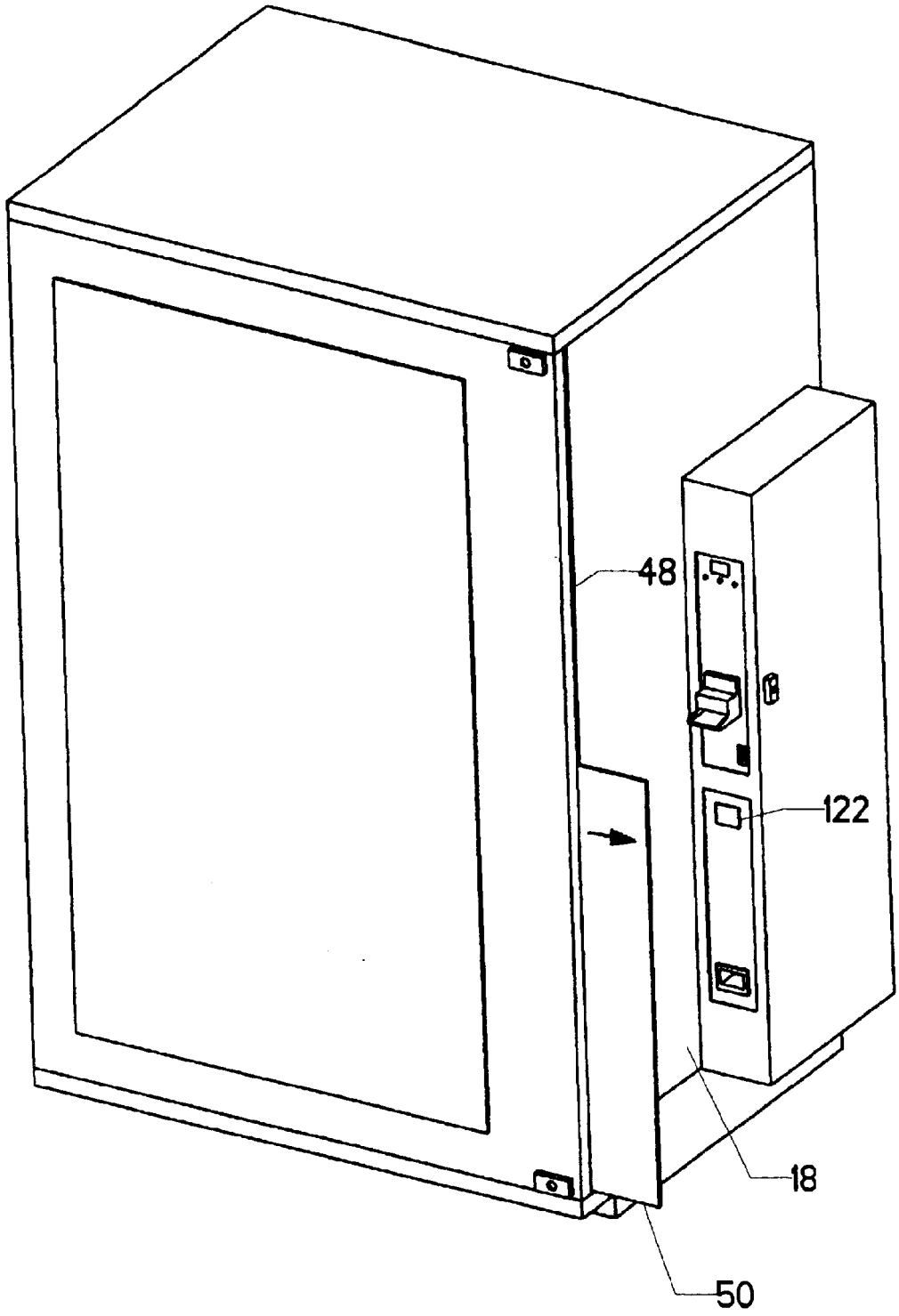
FIG. 3 is an isometric view, showing a carton being dispensed.
Figure 4:
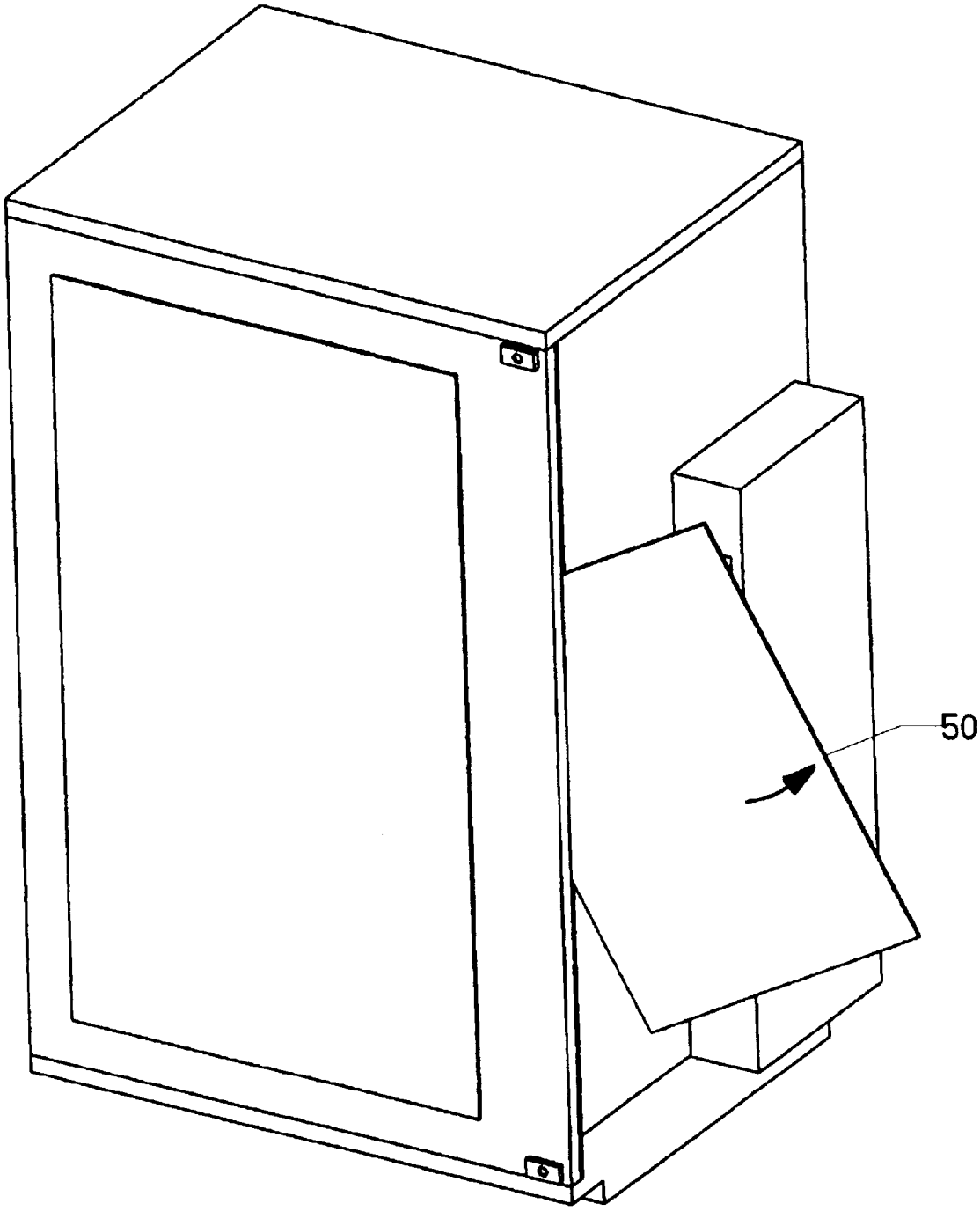
FIG. 4 is an isometric view, showing a carton being dispensed.

Once a customer has deposited the requisite amount of money, the machine dispenses a carton. Turning now to FIG. 3, the reader will observe the presence of dispenser slot 48 in the side of the machine. This opening passes through to the interior of the cabinet. When the vend cycle is complete, carton 50 will be ejected through dispenser slot 48, coming to rest approximately in the position shown. Remove carton light 122 will then be illuminated. It may optionally be set to flash in order to gain the customer's attention. The customer then grasps carton 50 and pulls it free of dispenser slot 48 as shown in FIG. 4. A proximity sensor within the machine senses that the carton has been removed and the control unit then resets the machine. Ready light 36 is then re-illuminated (having been switched off during the vend cycle) to indicate that the machine is ready for another purchase. Once carton 50 is free of the machine, the customer can unfold it so that it is ready for use.

Figure 5:
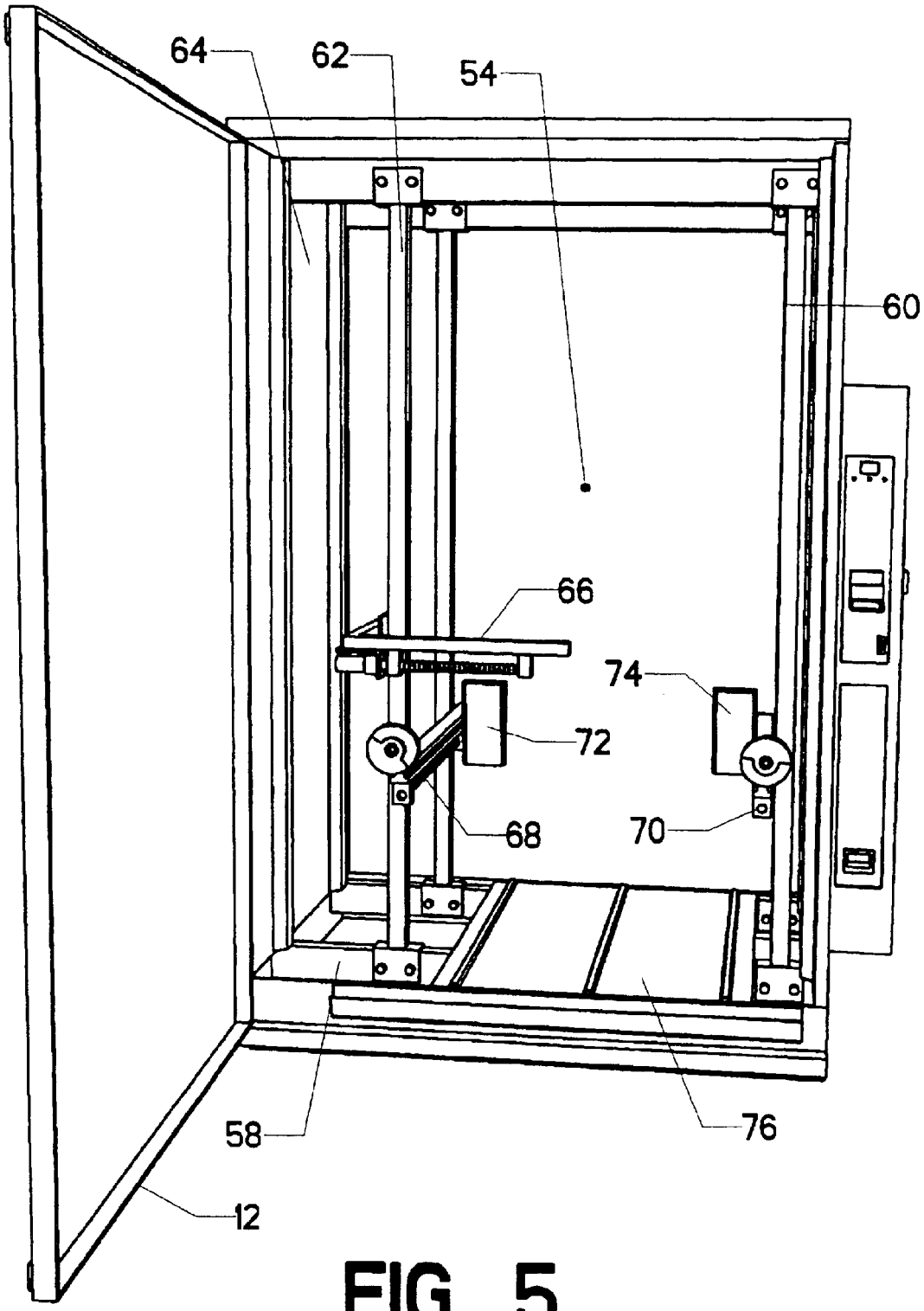
FIG. 5 is a perspective view, showing the details of the vending machine's interior.

FIG. 5 shows the interior details of the cabinet. Main door 12 is shown in the open position. The interior is designated generally as carton cavity 54. Left feed assembly 68 is provided to engage and move the left side of the cartons (with "left" being in reference to the view as shown). Right feed assembly 70 is provided to engage and move the right side of the cartons. Left pressure plate 72 and right pressure plate 74 push against the rear of the cartons to advance them toward the front of the cabinet. Cross feed assembly 66 is provided to eject an individual carton out the dispenser slot in the side of the machine.

The machine is capable of handling cartons of varying size. Adjustment means must therefore be provided. The feed mechanisms are generally attached to a set of upper beams 56 and lower beams 58. Right feed assembly 70 is attached to a pair of fixed columns 60. Left feed assembly 68 is attached to a pair of adjustable columns 62. Adjustable columns 62 can be moved left and right to accommodate variations in the width of the cartons—as shown by the arrows. Left feed assembly 68, right feed assembly 70, and cross feed assembly 66 are vertically adjustable in order to accommodate variations in the height of the cartons.

Left side panel 64 completes the structure of the cabinet. Support panel 76 is positioned to carry the weight of the cartons placed within the cabinet. It contains three raised ribs which minimize surface contact between the bottom edge of the cartons and the machine. These features reduce friction as the cartons are fed forward.

Figure 6:
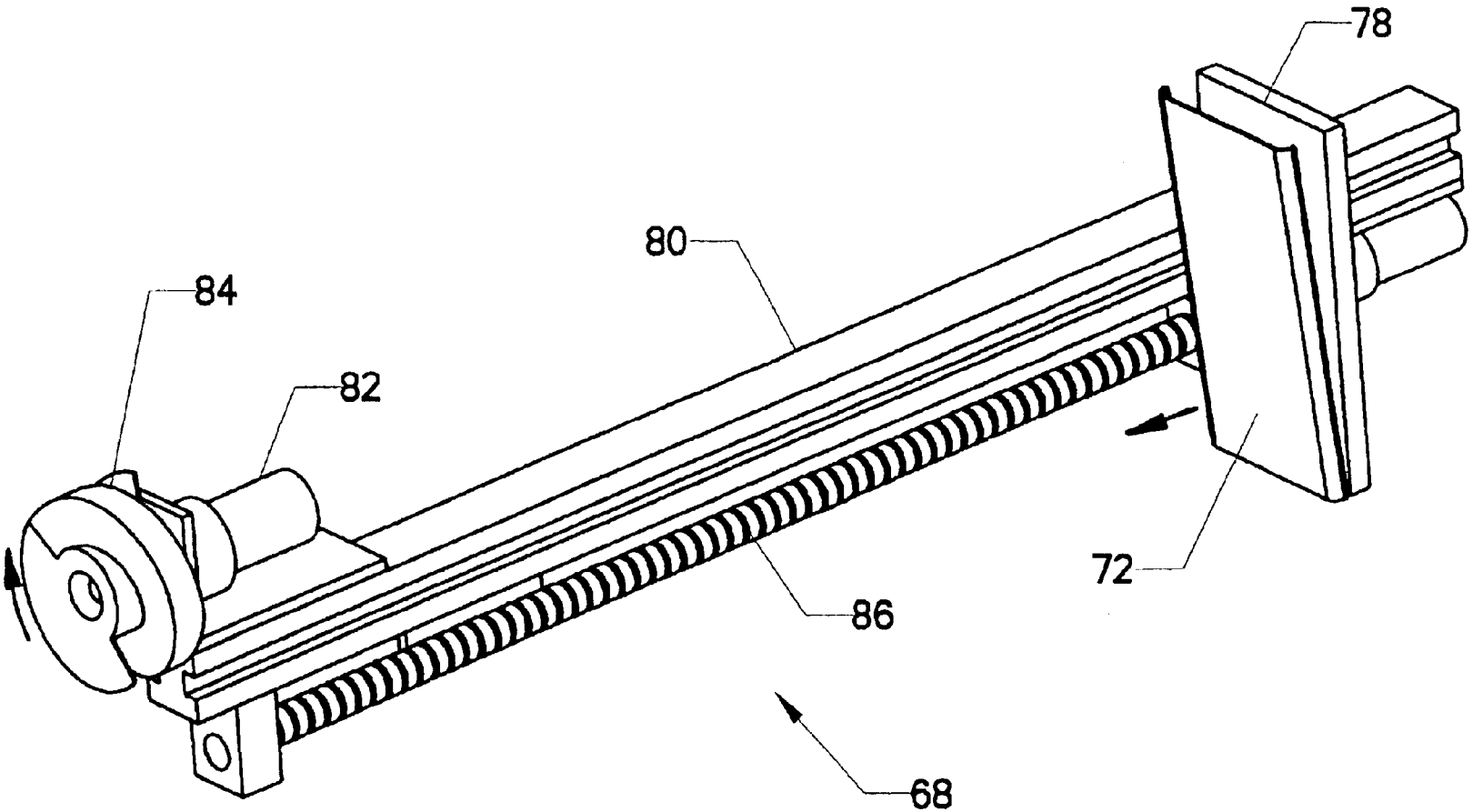
FIG. 6 is an isometric view, showing the left feed assembly.

FIG. 6 shows left feed assembly 68 removed from the machine for purposes of visualization. Left support beam 80 severs as an attachment point for the other features. Gear motor 82 is attached to its forward end. It controls and turns left drive helix 84—which rotates in the direction shown. Screw drive 86 is provided to move left pressure plate 72 back and forth in the direction indicated. Left pressure plate 72 is mounted to left backing plate 78. Left backing plate 78 is attached via a linear bearing to left support beam 80. When screw drive 86 turns, left backing plate 78 is moved forward or backward, depending on the direction of rotation of screw drive 86.

Left pressure plate 72 is attached to left backing plate 78 using elastic means, so that left pressure plate 72 can give somewhat with respect to left backing plate 78. Sensing means are preferably provided for all these drive mechanisms. As a first example, optical sensors can be used to determine the position of the rear of the stack of cartons. The control unit will then activate screw drive 86 to advance left pressure plate 72 until it bears against the rear of the stack. The use of the elastic means in pressure plate 72 eliminates the need for precise motion control. As a second example, it is important that left drive helix 84 undergo one complete revolution per vending cycle. This can be accomplished using a limit switch, optical sensor, or other common means. As these sensing and control features represent common design choices known in the art, they have not been illustrated.

Figure 7:
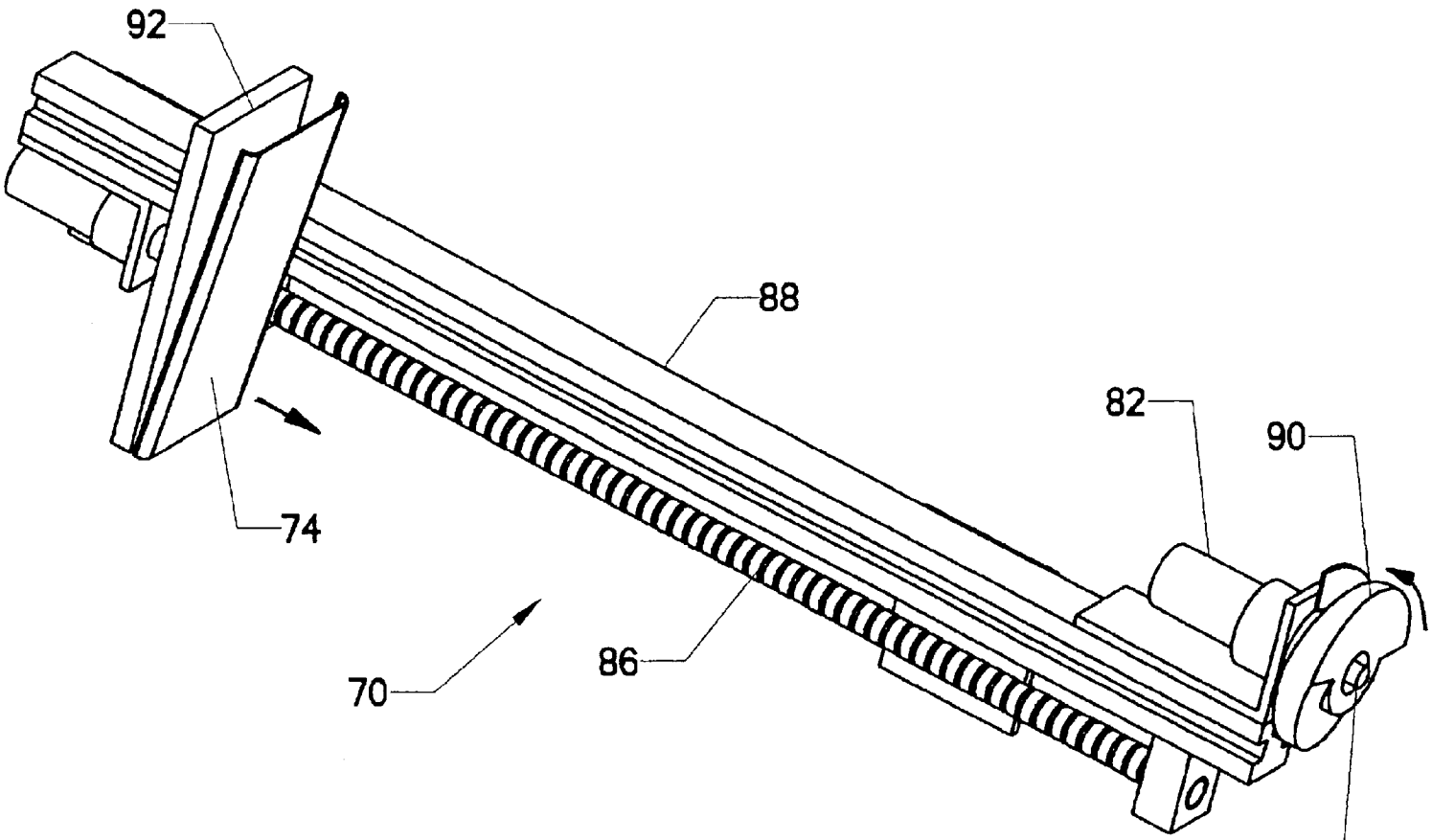
FIG. 7 is an isometric view, showing the right feed assembly.

FIG. 7 shows the details of right feed assembly 70. It is essentially the mirror image of left feed assembly 68. It contains right support beam 88, a second screw drive 86, right backing plate 92, right pressure plate 74, a second gear motor 82, and right drive helix 90. The reader should observe that right drive helix 90 is not necessarily a mirror of left drive helix 84. It may, in fact, be somewhat shorter, so that it releases its engagement with the right side of the carton before left drive helix 84 releases its engagement.

Proximity sensor 120 is provided on the spindle of right drive helix 90. When a carton has been advanced forward via the two feed assemblies and fed transversely through the dispensing slot, proximity sensor 120 senses the presence of the carton. If the customer does not remove the carton at this point, it is undesirable for the machine to feed another carton—as the presence of two cartons in the dispensing slot could cause a jam. Thus, proximity sensor 120 alerts the control unit to the presence of a carton in the dispenser slot and prevents more feeding until it is removed. The position and type of proximity sensor 120 is a matter of design choice. It need not be placed on or near right drive helix 90, so long as it is capable of sensing the presence of a carton. Suitable choices include mechanical limit switches and optocouplers.

Figure 8:
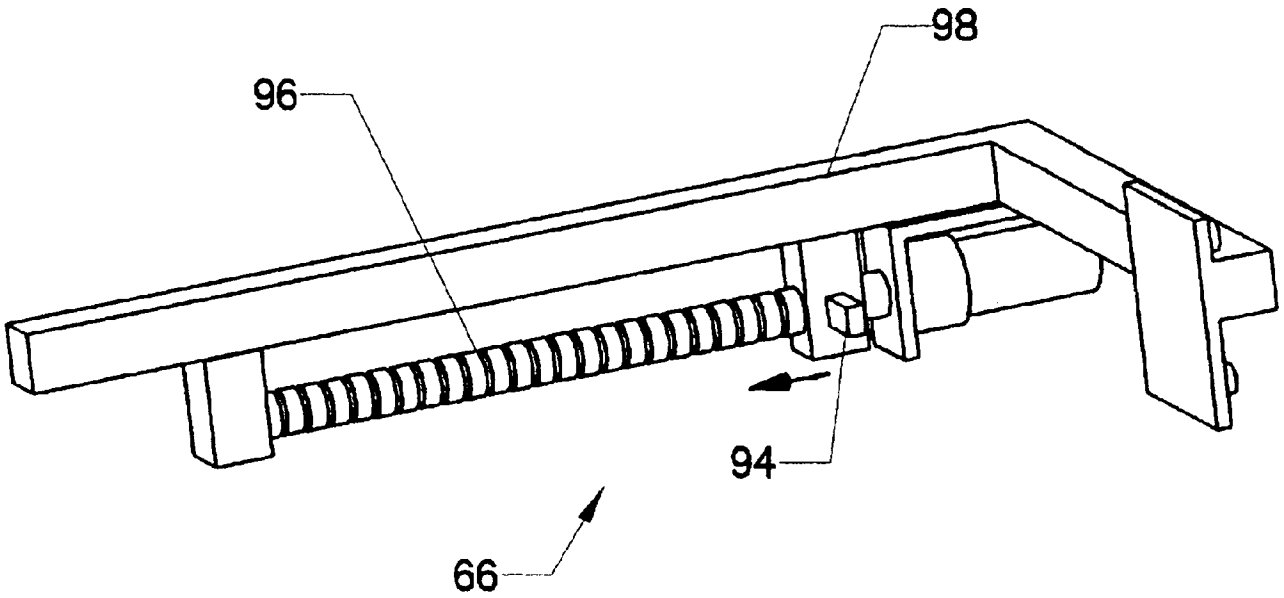
FIG. 8 is an isometric view, showing the crossfeed assembly.

FIG. 8 shows cross feed assembly 66. It is supported by cross feed bracket 98, which attaches to the forward adjustable column 62. Transverse screw drive 96 provides controlled reciprocating motion of ejector 94. Ejector 94 incorporates a protrusion which bears against the left side of a carton and pushes it out the dispenser slot.

Figure 9:
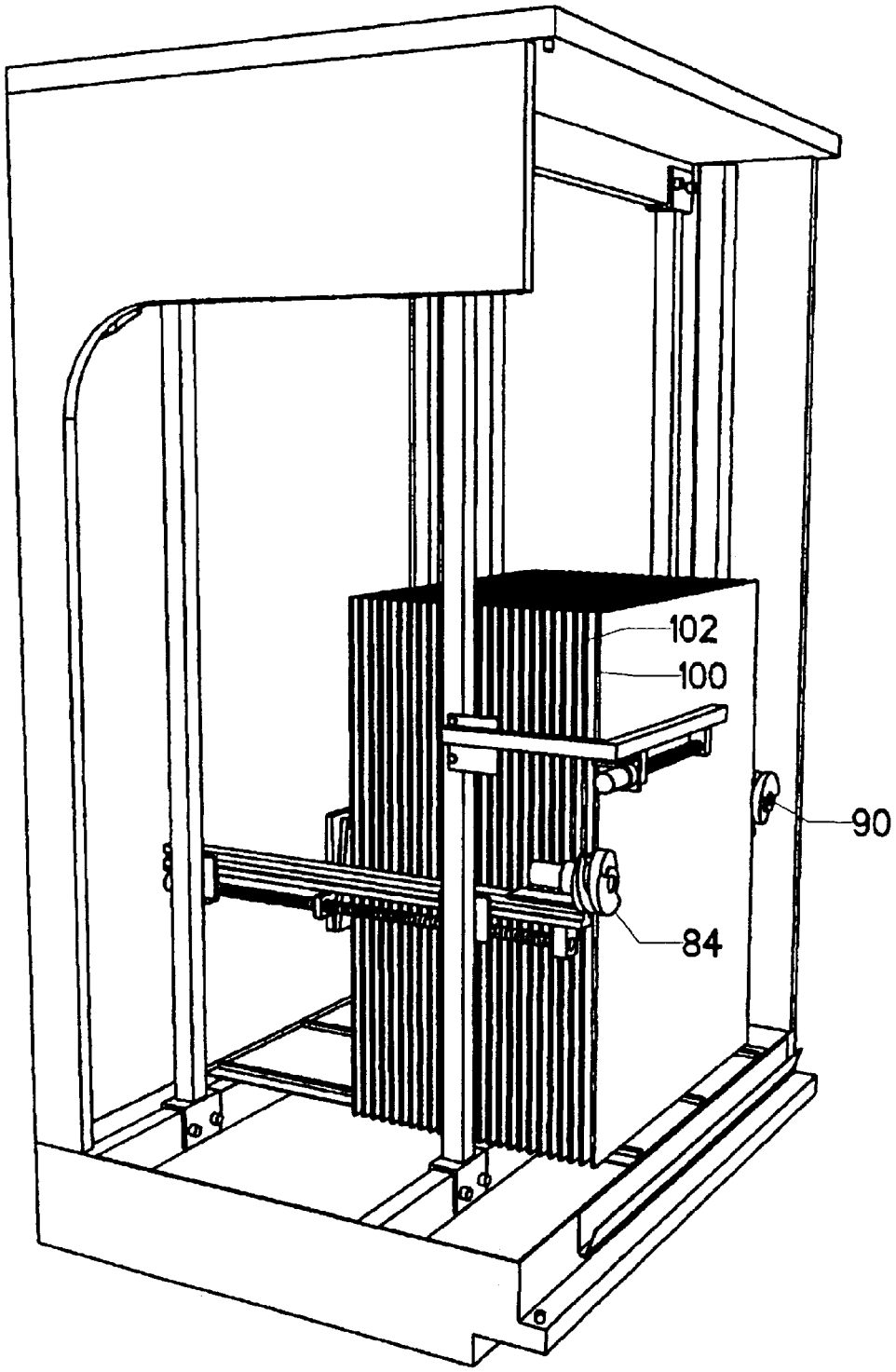
FIG. 9 is a perspective view with a cutaway, showing the feeding process.

FIG. 9 is a perspective view of the loaded machine. Main door 12 is removed in the view to expose the internal components. A cutaway is made in left side panel 64 as well. The machine is shown in its ready state. A stack of vertically oriented cartons is contained within the cabinet. Left drive helix 84 and right drive helix 90 engage the left and right edge of lead carton 100. Next carton 102 is in position to be engaged by the drive helices once lead carton 100 is dispensed. The reader will observe that the two pressure plates are bearing against the rear of the stack of cartons to urge it forward.

Figure 10:
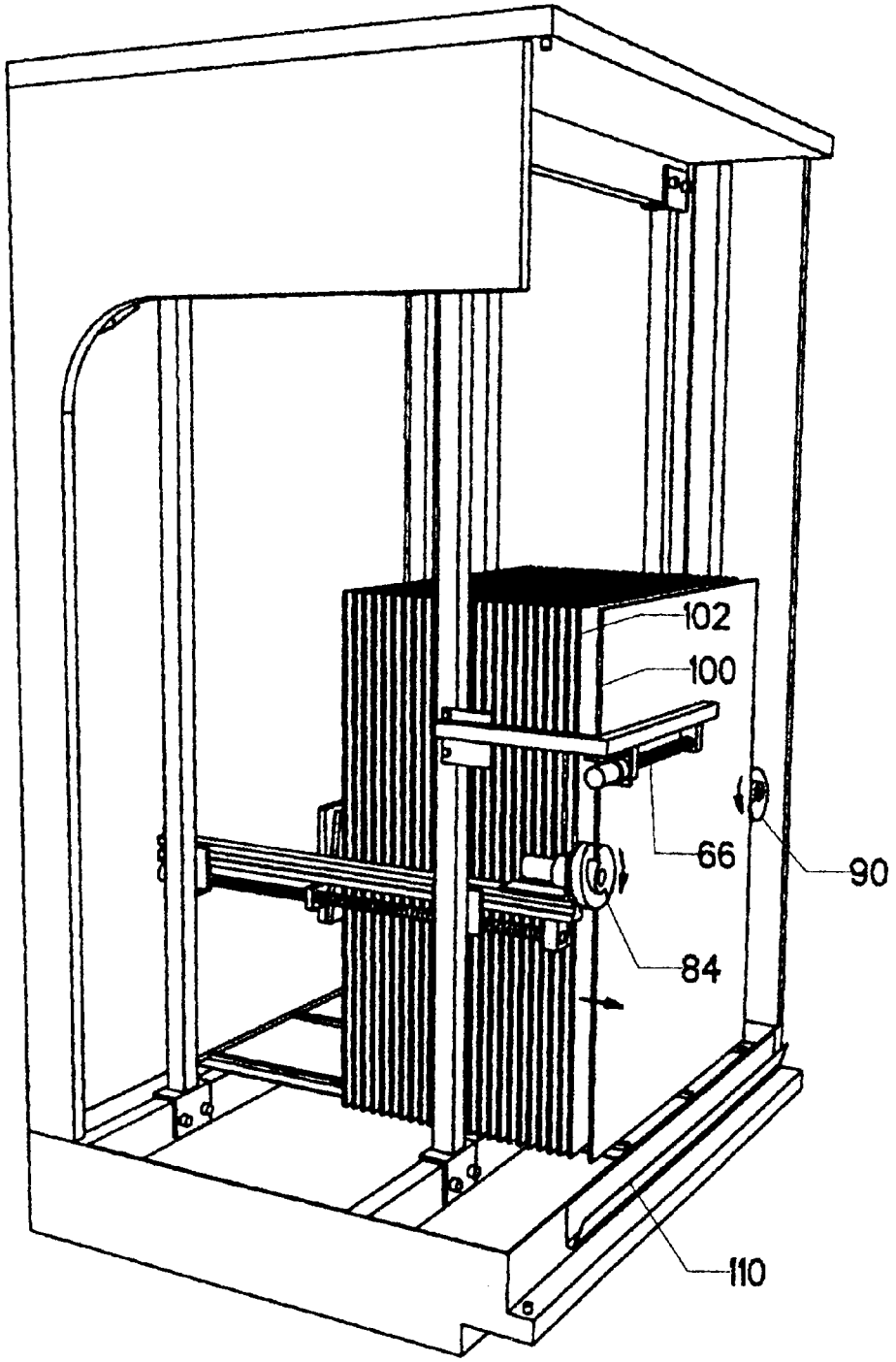
FIG. 10 is a perspective view with a cutaway, showing the feeding process.
Figure 11:
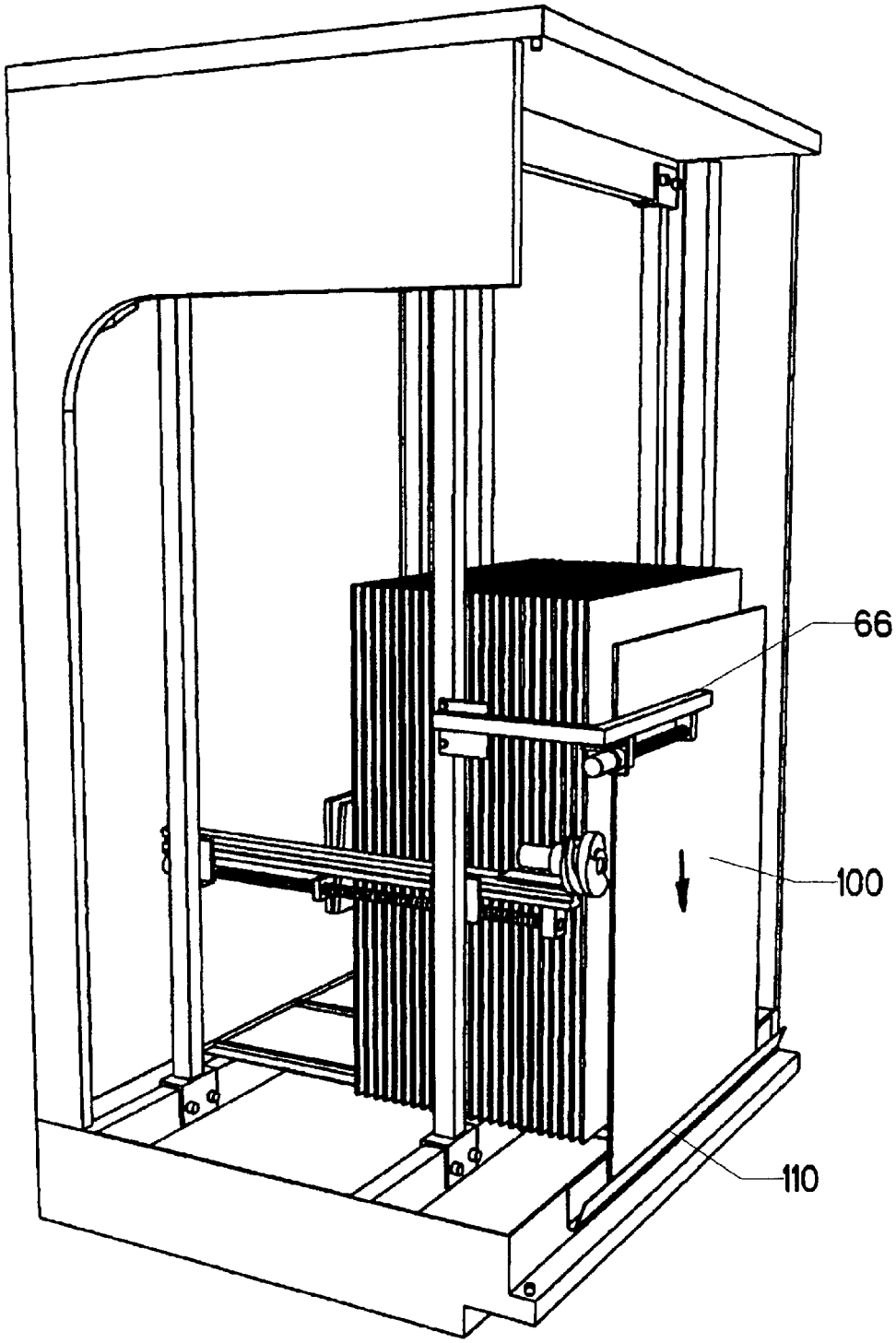
FIG. 11 is a perspective view with a cutaway, showing the feeding process.

When the controller initiates the vend cycle, the two drive helices turn and lead carton 100 is moved forward. FIG. 10 shows this step. The two drive helices rotate in opposite directions, as shown by the arrows. Lead carton 100 is propelled forward while next carton 102 remains stationary (the features which hold next carton 102 in place will be describe subsequently). The two drive helices rotate until lead carton 100 is ejected from the helices and drops off the front of support panel 76, falling into tray 110. It is prevented from tipping forward by cross feed assembly 66 (as well as the inside surface of main door 12—which is not shown).

Figure 12:
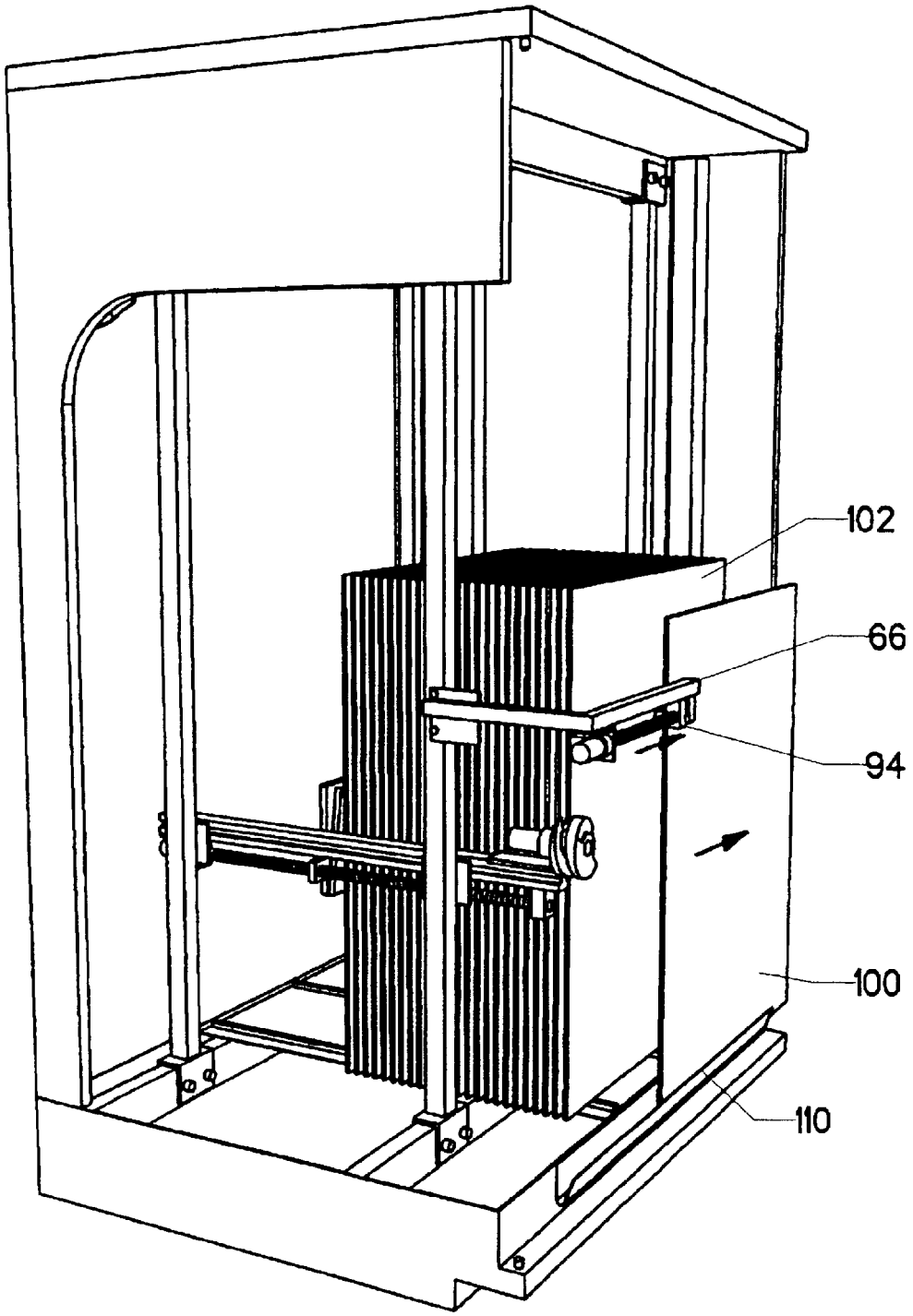
FIG. 12 is a perspective view with a cutaway, showing the feeding process.

FIG. 12 shows the final step in the vend cycle. The screw drive on cross feed assembly 66 is actuated, driving ejector 94 to the right. Lead carton 100 is thereby ejected from the machine. Next carton 102 then assumes the position formerly occupied by lead carton 100 and the cycle is ready to begin anew.

Figure 13:
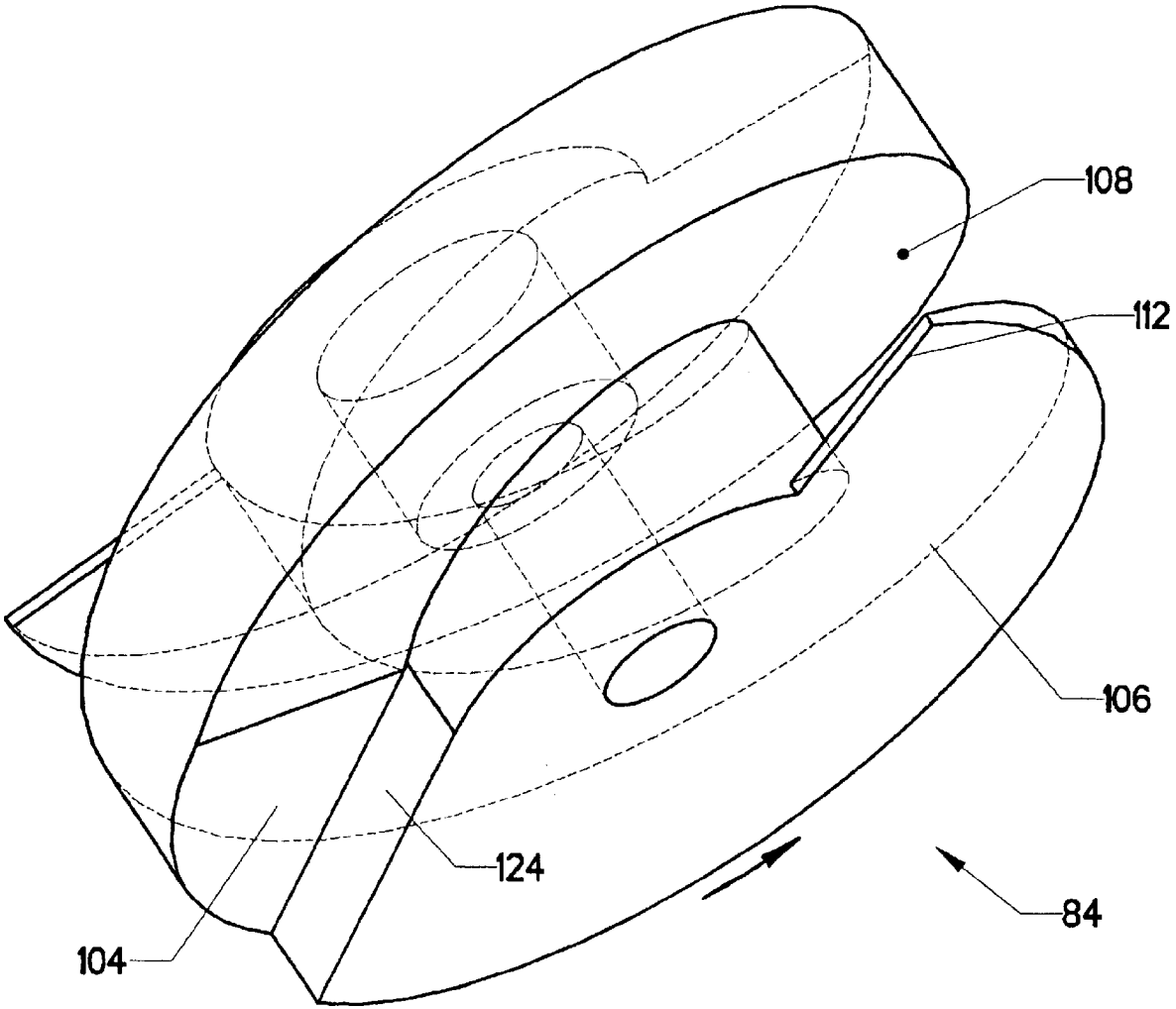
FIG. 13 is an isometric view, showing the left drive helix.

FIG. 13 shows left drive helix 84 in detail. It is viewed from the rear. Holding flange 106 would be facing the forward surface of lead carton 100 in its installed position. It customarily rotates in the direction shown by the arrow. Feed groove 108—which assumes the form of a helical slot—provides the forward motion of the carton when left drive helix 84 is actuated.

The position shown corresponds to the initiation of a cycle. Vertical wall 124 is, at this point, oriented vertically. The vertical edge of the lead carton (the left edge, when viewed from the front), slips past vertical wall 124 and comes to rest against entrance step 104. The lead carton's edge is therefore poised to enter feed groove 108. When left drive helix 84 is rotated in the direction shown, carton separator 112 rotates between the edge of the lead carton and the next carton—thereby separating the two. Holding flange 106 rotates in front of the next carton, preventing its moving forward while the drive helix goes through one revolution. The lead carton is therefore propelled forward and ultimately out of the drive helix while the next carton is held in place. Once the drive helix rotates through 360 degrees and returns to the position shown, the next carton pops forward past vertical wall 124 and into entrance stop 104. These operations are detailed in the following views.

Figure 14:
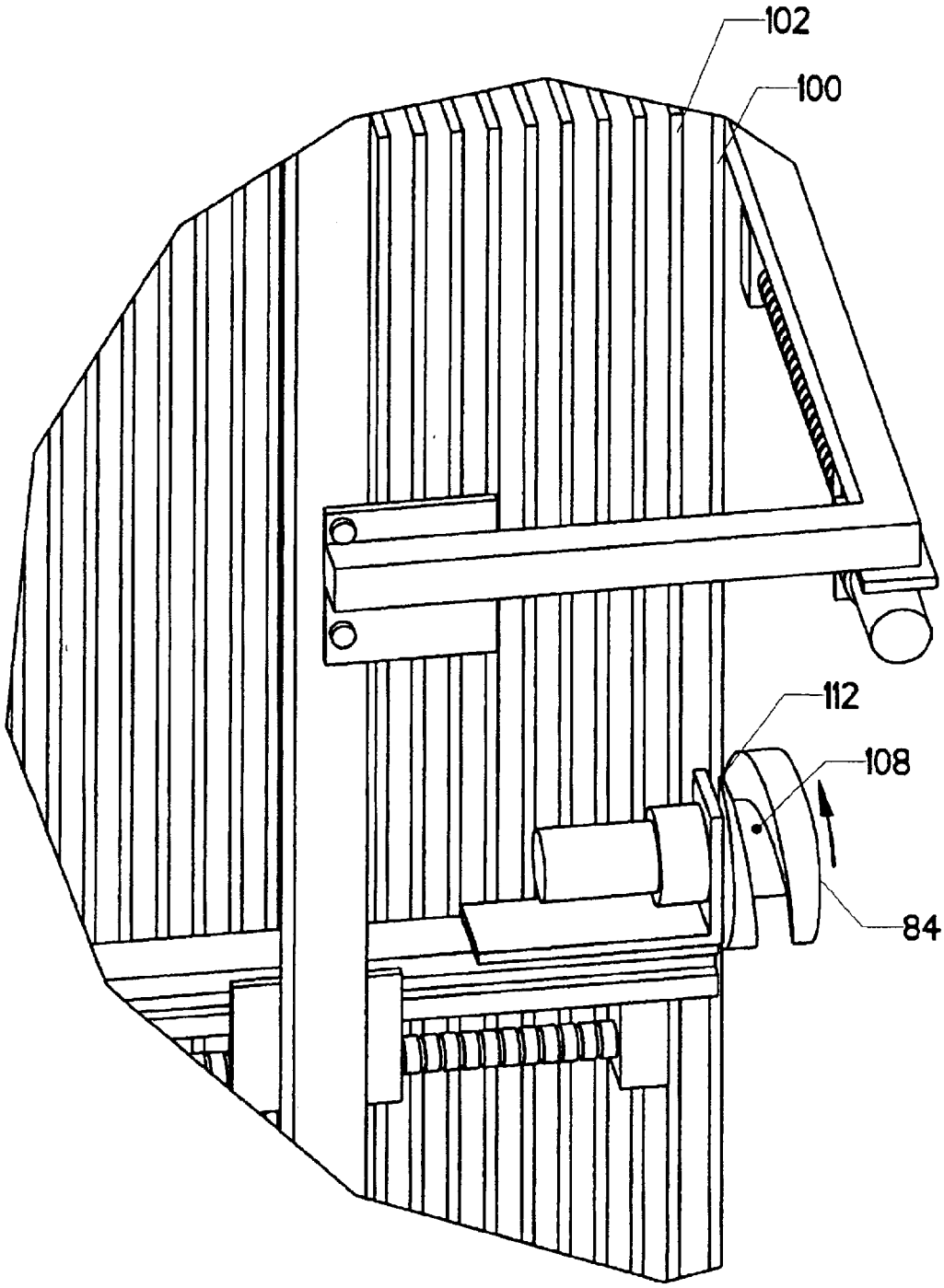
FIG. 14 is a detail view, showing the feeding process.
Figure 15:
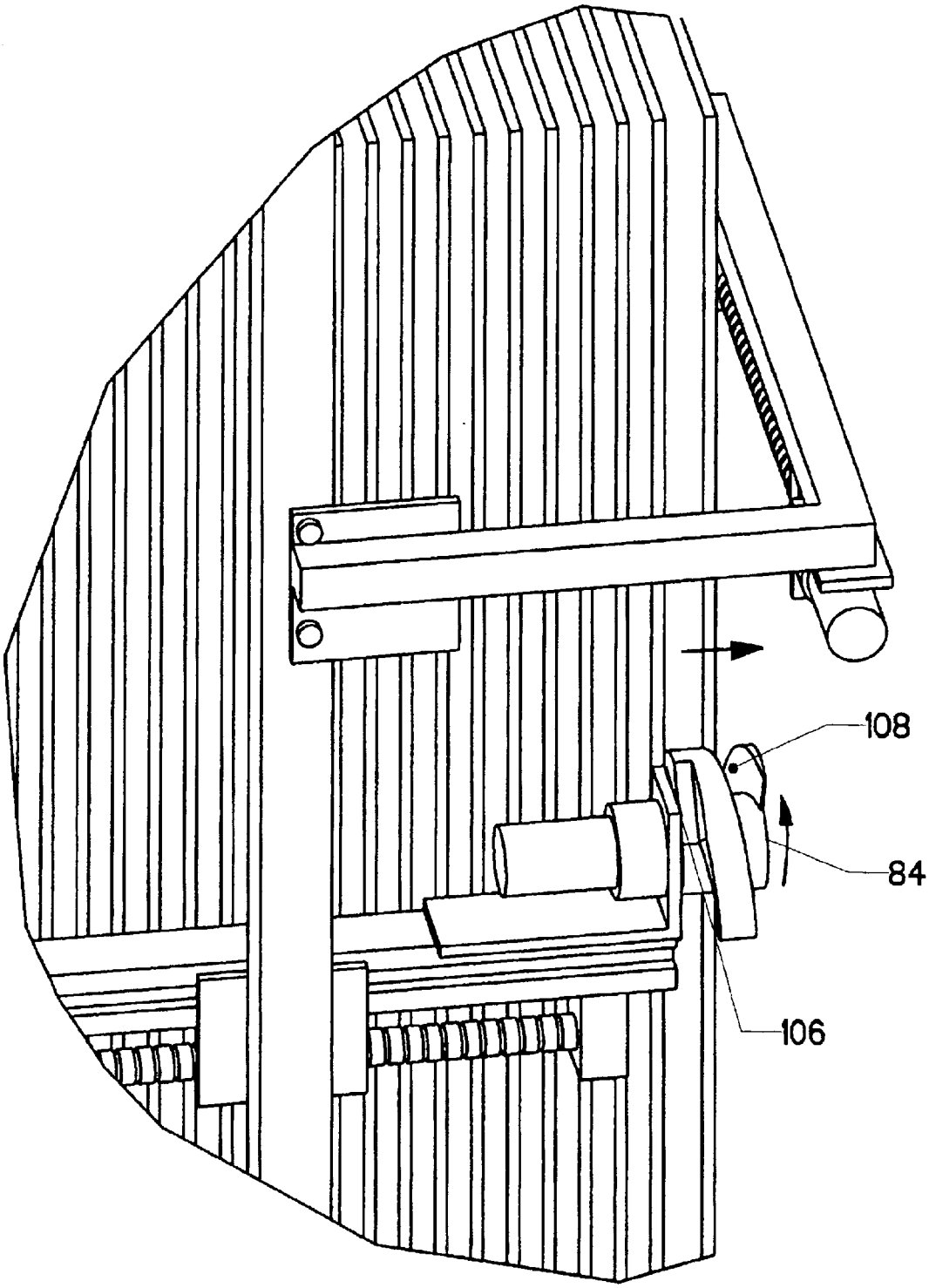
FIG. 15 is a detail view, showing the feeding process.

FIG. 14 is a detail view showing the start of the cycle. The edge of lead carton 100 is resting in entrance stop 104. When left drive helix 84 rotates as shown, carton separator 112 will pass behind the edge of lead carton 100 and in front of the edge of next carton 102. Feed groove 108 then propels lead carton 100 forward. FIG. 15 shows left drive helix 84 after it has rotated 180 degrees. Lead carton 100 has been propelled forward, while next carton 102 is held in place by holding flange 106.

Figure 16:
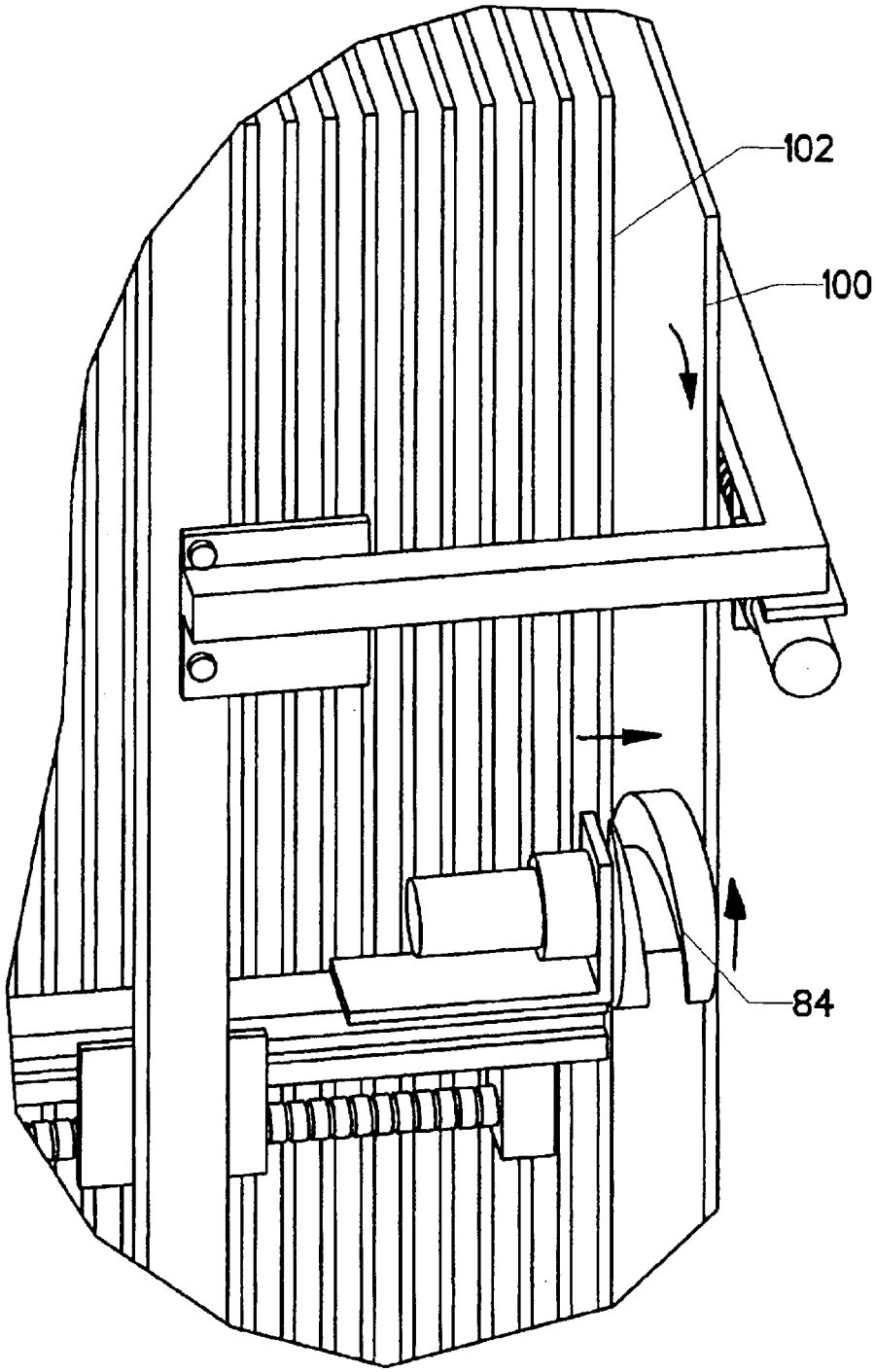
FIG. 16 is a detail view, showing the feeding process.

FIG. 16 shows left drive helix 84 after one complete revolution. Lead carton 100 has been propelled forward and out of the drive helices, dropping down into tray 110. The reader will also observe that next carton 102 has moved forward into entrance stop 104.

Figure 17:
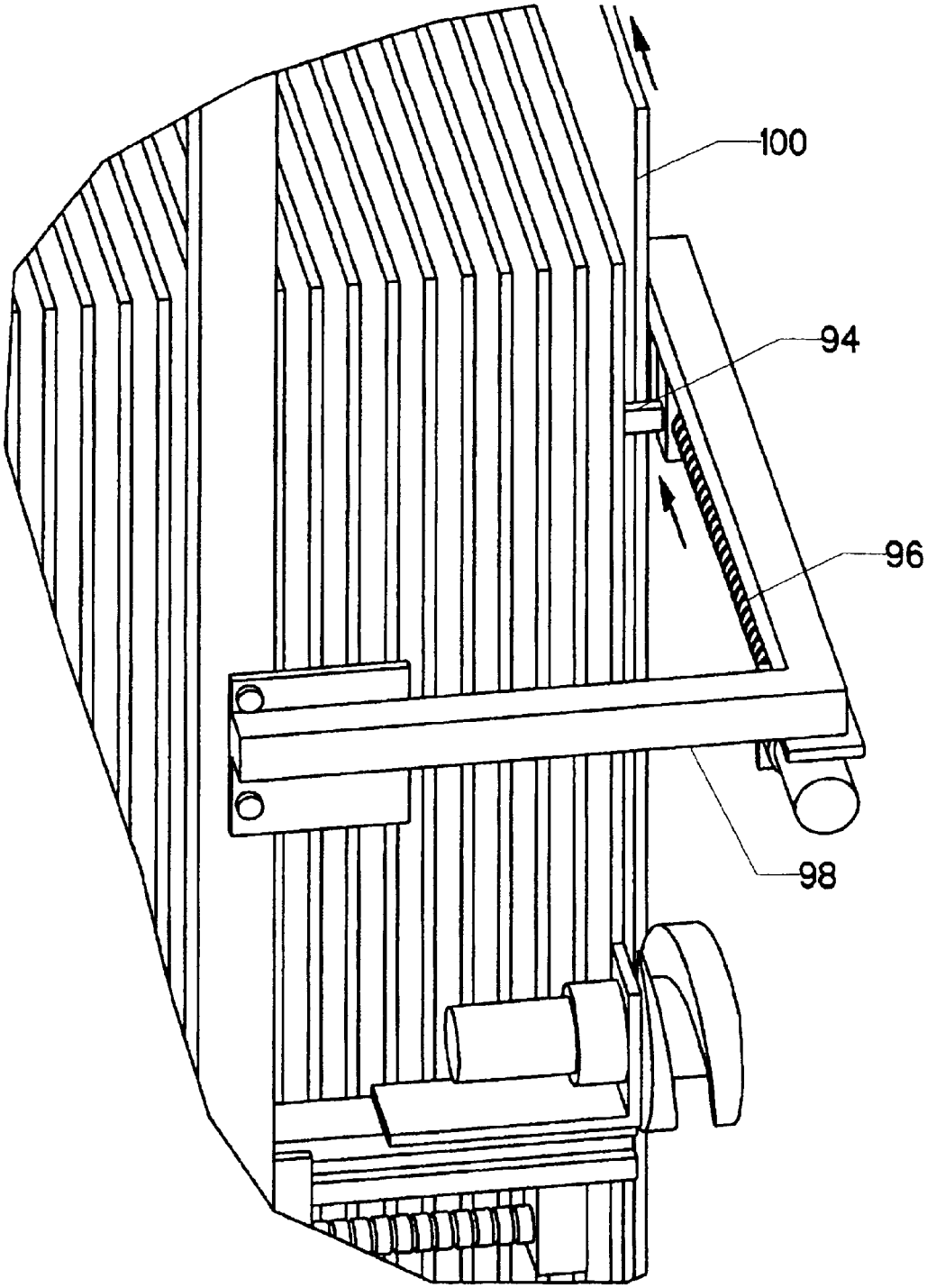
FIG. 17 is a detail view, showing the feeding process.

FIG. 17 shows the actuation of ejector 94. The inward facing protrusion on ejector 94 bears against the edge of lead carton 100 and propels it toward the machine's right side, where it is ejected through the ejection slot. Tray 110 and ejector 94 guide its lateral motion. Features on the inside of the main door—such as roller or runners—can also be employed to ensure that lead carton 100 passes through the dispenser slot and out of the machine. After the completion of the lateral ejection, the machine is ready to begin a new cycle. Once the customer has grasped and removed lead carton 100 (and proximity sensor 120 has indicated such), a new cycle can begin.

Figure 18:
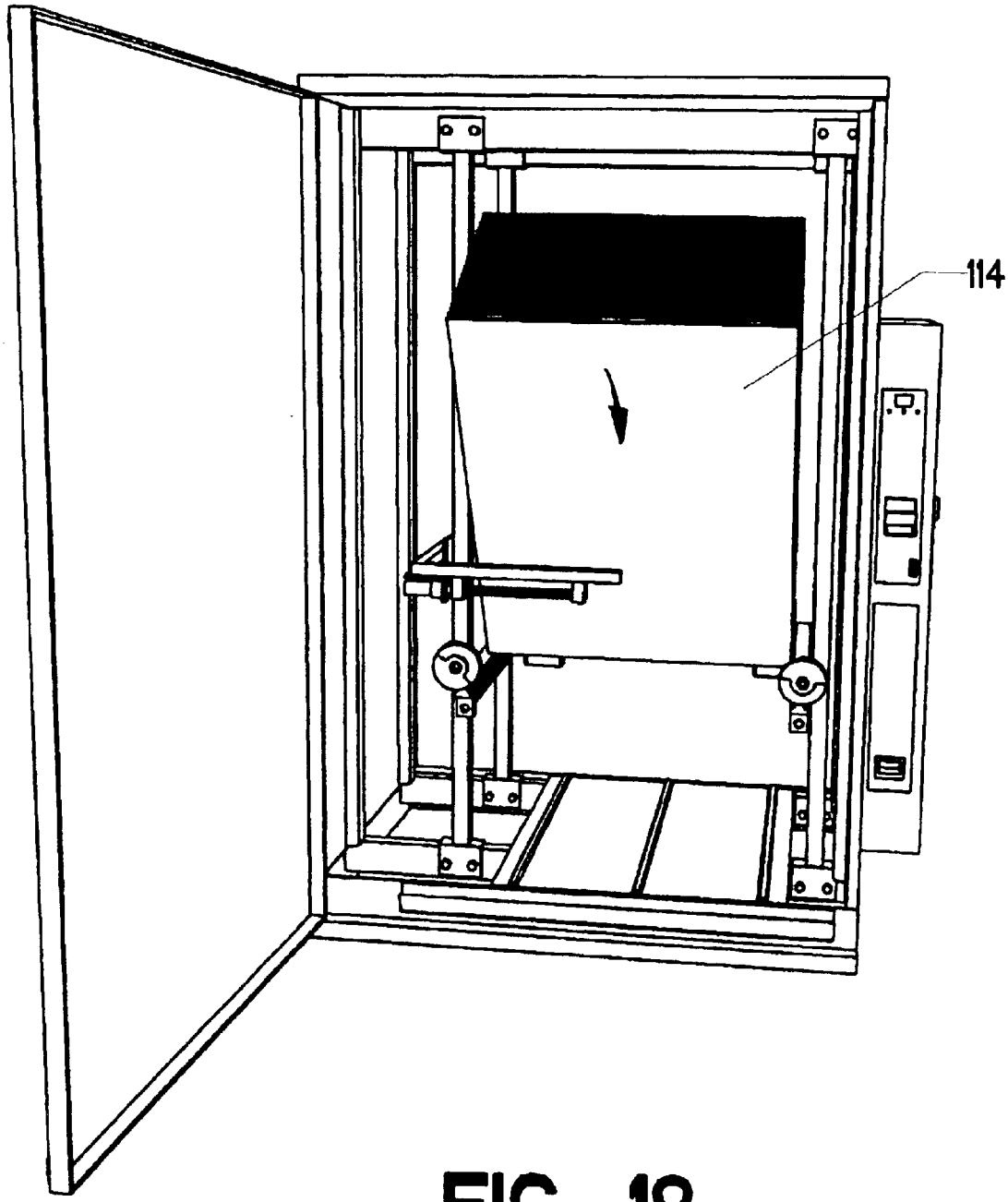
FIG. 18 is a perspective view, showing the loading of the machine.

The vending cycles continue until the machine exhausts its supply of cartons. It must then be reloaded. The controller, once it senses the exhaustion of the carton supply, retracts the two pressure plates to their rearmost position. FIG. 18 shows the machine with the main door open. A service person then loads carton stack 114 into the machine as shown. Of course, cartons can also be loaded individually.

Common prior art features can be added to facilitate the reloading process, As an example, the left, right, and cross feeding assemblies can be mounted on hinges to swing out of the way when the machine is to be loaded. As such principles are well known in the art, they have not been illustrated in detail.

The preceding descriptions contain significant detail regarding the novel aspects of the present invention. They should not be construed, however, as limiting the scope of the invention but rather as providing illustrations of the preferred embodiments of the invention. Thus, the scope of the invention should be fixed by the following claims, rather than by the examples given.

Having described our invention, we claim:

1. A machine for dispensing flat objects to a user, comprising:

a. a cabinet, having a front, a rear, and a side, capable of containing a plurality of said flat objects in a vertical orientation;

b. a dispenser slot opening in said side of said cabinet;

c. biasing means tending to push said plurality of flat objects from said rear of said cabinet toward said front of said cabinet;

d. at least one drive helix having a helical feed groove, and positioned so that said feed groove engages an edge of the lead carton of said plurality of flat objects and urges it toward said front of said cabinet when said at least one drive helix is rotated;

e. an extractor, positioned to engage an edge of said lead carton of said plurality of flat objects and urge it toward said side of said cabinet and through said dispenser slot;

f. money accepting means, capable of receiving and counting a specified amount of money; and g. control means, so that when said user deposits said specified amount of money in said machine, said control means causes said at least one drive helix to rotate until said lead carton of said plurality of flat objects is moved past said at least one drive helix, and thereafter said control means causes said extractor to move and push said lead carton of said plurality of flat objects out said dispenser slot, where it can be grasped and removed by said user.

2. A machine as recited in claim 1, wherein said cabinet is provided with a first lock to prevent unauthorized persons from removing said plurality of flat objects from within said cabinet.

3. A machine as recited in claim 2, wherein said money accepting means is provided with a second lock to prevent unauthorized persons from removing money from said money accepting means.

4. A machine as recited in claim 3, wherein said first and second locks are opened by a different key, so that different persons can be given access to said cabinet or said money accepting means.

5. A machine as recited in claim 1, wherein said biasing means comprises a screw drive pushing a pressure plate.

6. A machine as recited in claim 1, further comprising a tray, for holding a lower edge of said lead carton of said plurality of flat objects after it has moved forward past said at least one drive helix in order to guide said lead carton out said dispenser slot.

7. A machine as recited in claim 1, wherein said biasing means and said at least one drive helix are adjustable in position so as to accommodate variations in the size of said plurality of if flat objects.

8. A machine as recited in claim 1, further comprising a proximity sensor for detecting when said user has removed said lead carton of said plurality of flat objects from said dispenser slot.

9. A machine as recited in claim 1, wherein:

a. said at least one drive helix has a front side and a back side;

b. said back side faces a front surface of said lead carton of said plurality of flat objects;

c. said back side includes a holding flange, a carton separator, and an entrance stop;

d. said carton separator separates said lead carton of said plurality of flat objects from said plurality of flat objects as said at least one drive helix rotates;

e. said holding flange holds a next carton in said plurality of flat objects in position until said at least one drive helix has completed one revolution; and f. said entrance stop allows said next carton to advance into the position formerly occupied by said lead carton once said at least one drive helix has completed one revolution.

* * * * *